US006148920A

United States Patent [19]

McCalvin

[11] Patent Number: 6,148,920

[45] Date of Patent: Nov. 21, 2000

[54] EQUALIZING SUBSURFACE SAFETY VALVE WITH INJECTION SYSTEM

[75] Inventor: David E. McCalvin, Sugar Land, Tex.

[73] Assignee: Camco International Inc., Houston, Tex.

[21] Appl. No.: 09/173,993

[22] Filed: Oct. 16, 1998

Related U.S. Application Data

[60] Provisional application No. 60/062,297, Oct. 17, 1997.

[51] Int. Cl.[7] ..... E21B 34/10

[52] U.S. Cl. ..... 166/324; 166/325; 166/332.8; 166/375; 166/386

[58] Field of Search ..... 166/386, 383, 166/374, 375, 902, 321, 324, 325, 332.8, 332.7

[56] References Cited

U.S. PATENT DOCUMENTS

| | | | |
|---|---|---|---|
| 2,179,033 | 11/1939 | Cashion et al. . | |
| 2,726,723 | 12/1955 | Wilhoit et al. . | |
| 2,852,080 | 9/1958 | Roach . | |
| 2,902,094 | 9/1959 | Nelson et al. . | |
| 2,960,165 | 11/1960 | Schramm . | |
| 2,968,351 | 1/1961 | Jones . | |
| 3,362,477 | 1/1968 | Brandt . | |
| 3,378,079 | 4/1968 | Page, Jr. . | |
| 3,754,597 | 8/1973 | Garrett . | |
| 4,042,033 | 8/1977 | Holland et al. . | |
| 4,161,219 | 7/1979 | Pringle . | |
| 4,256,282 | 3/1981 | Goldschild et al. | 251/58 |
| 4,306,624 | 12/1981 | Bernard et al. . | |
| 4,371,038 | 2/1983 | Abernathy et al. . | |
| 4,399,871 | 8/1983 | Adkins et al. . | |
| 4,432,417 | 2/1984 | Bowyer . | |
| 4,448,216 | 5/1984 | Speegle et al. . | |
| 4,460,040 | 7/1984 | Bowyer . | |
| 4,480,687 | 11/1984 | Terral . | |
| 4,505,155 | 3/1985 | Jackson . | |
| 4,534,414 | 8/1985 | Pringle . | |
| 4,582,131 | 4/1986 | Plummer et al. . | |
| 4,625,803 | 12/1986 | Walhaug et al. . | |
| 4,681,167 | 7/1987 | Soderberg | 166/371 |
| 4,691,777 | 9/1987 | Williamson, Jr. . | |
| 4,691,779 | 9/1987 | McMahan et al. . | |
| 4,694,908 | 9/1987 | Morris et al. . | |
| 4,703,805 | 11/1987 | Morris . | |
| 4,749,036 | 6/1988 | Read . | |
| 4,836,287 | 6/1989 | Couste et al. . | |
| 4,842,074 | 6/1989 | Hines et al. . | |
| 4,869,595 | 9/1989 | Lang . | |
| 4,896,725 | 1/1990 | Parker et al. . | |
| 4,907,655 | 3/1990 | Hromas et al. . | |
| 5,004,007 | 4/1991 | Johnson et al. . | |
| 5,117,913 | 6/1992 | Themig . | |
| 5,141,056 | 8/1992 | Tailby . | |
| 5,179,973 | 1/1993 | Dickson et al. | 137/433 |
| 5,246,074 | 9/1993 | Ayres . | |
| 5,365,769 | 11/1994 | Ferry . | |

FOREIGN PATENT DOCUMENTS

| | | |
|---|---|---|
| 2127563 | 4/1984 | United Kingdom . |

OTHER PUBLICATIONS

Camco CAD Drawing No. 22901–000 entitled 4–1/2 Injection Mandrel, Mar. 1995.

Camco CAD Drawing No. 2346–000 entilted 3–1/2 Chemical Inj. Sub with Rupture Disk, Jul. 1998.

Camco CAD Drawing No. 23181–000 entitled 5–1/2 Chemical Injection Nipple, May 1998.

*Primary Examiner*—William Neuder
*Assistant Examiner*—Zakiya Walker
*Attorney, Agent, or Firm*—Goldstein & Healey, LLP

[57] ABSTRACT

A pressure equalizing subsurface safety valve with a fluid injection system is provided. A fluid injection conduit is connected from a source of injection fluid, such as at the earth's surface, to the subsurface safety valve. A fluid flowpath is provided in the safety valve to transmit injection fluid from the fluid injection conduit to a longitudinal bore of the safety valve. The injection fluids are introduced into the longitudinal bore to resist corrosion of or other damage to the safety valve. The fluid may be injected into the longitudinal bore through a single port, or through a plurality of ports. The fluid injection conduit may also be used to equalize pressure above and below a closure member disposed within the safety valve prior to the opening of the closure member.

35 Claims, 7 Drawing Sheets

EQUALIZING SUBSURFACE SAFETY VALVE WITH INJECTION SYSTEM

RELATED APPLICATIONS

This application claims the benefit of U. S. Provisional Application No. 60/062,297, filed Oct. 17, 1997.

BACKGROUND OF THE INVENTION

1. Field of the Invention

The present invention relates to a subsurface safety valve used for controlling fluid flow in a well conduit and, more particularly, to a pressure equalizing subsurface safety valve having a fluid injection system.

2. Description of the Related Art

Subsurface safety valves are commonly used in wells to prevent uncontrolled fluid flow through the well in the event of an emergency, such as to prevent a well blowout. Conventional safety valves use a flapper which is biased by a spring to a normally closed position, but is retained in an open position by the application of hydraulic fluid from the earth's surface. A typical subsurface safety valve is shown and described in U.S. Pat. No. 4,161,219, which is commonly assigned hereto.

One problem associated with subsurface safety valves relates to the corrosive effect of well fluids on the material from which subsurface safety valves have been made. One solution to this problem is to make the safety valve from materials that are resistant to such corrosion. The drawback to this solution is that, due to the greater expense of noble metals, the cost of the safety valve is much greater than before. An alternative to making the safety valve from these costlier materials is to inject various chemicals into the safety valve. The chemicals mix with the production fluid and protect the safety valve. The injection fluids may be chemicals such as for retarding corrosion, scale, parafin, asphaltenes, and the like. It is therefore an object of the present invention to provide an improved subsurface safety valve having a means for injecting fluids into the safety valve.

Another problem associated with subsurface safety valves may arise when moving the valve closure member from its closed to its open position. When the closure member is in the closed position, well fluid pressure below the closure member acting upon a relatively large surface area of the closure member makes opening of the closure member difficult. This difficulty in opening cannot be easily overcome simply by increasing the force exerted against the closure member by an opening piston and cylinder assembly because the relatively small cross-sectional area of the opening piston and cylinder assembly would require a fluid pressure that may burst the control line carrying hydraulic fluid from the earth's surface to the piston and cylinder assembly. Additionally, when the closure member is opened the initial flow of well fluid is relatively rapid which tends to etch, or erode, the primary sealing surface of the closure member. Any damage to this primary sealing surface is extremely critical because it is this sealing surface which must be intact to prevent uncontrolled flow of well fluids. The present invention solves these difficulties by providing a subsurface safety valve with an equalizing mechanism to allow the pressure above and below the closure member to equalize prior to the complete opening of the closure member.

SUMMARY OF THE INVENTION

The present invention has been contemplated to overcome the foregoing deficiencies and meet the above described needs. In a broad aspect, the invention may be a subsurface safety valve for controlling fluid flow in a well conduit including: a body member having a longitudinal bore extending therethrough; a valve actuator disposed for axial movement within the longitudinal bore; means for controllably moving the valve actuator within the longitudinal bore; a closure member mounted within the body member to control fluid flow through the longitudinal bore; means for biasing the closure member to a normally closed position to prevent fluid flow through the longitudinal bore; means for biasing the valve actuator away from the closure member; and, a fluid flowpath disposed within the body member, the flowpath being in fluid communication with the longitudinal bore and a source of injection fluid. Another feature of this aspect of the invention is that a fluid injection conduit may controllably connect the fluid flowpath to the source of injection fluid. Another feature of this aspect of the invention is that the valve may further include an annular fluid passageway disposed within the body member and in fluid communication with the fluid flowpath, and a plurality of fluid injection ports in fluid communication with the annular fluid passageway and the longitudinal bore. Another feature of this aspect of the invention is that the plurality of fluid injection ports may extend radially inwardly from the annular fluid passageway to the longitudinal bore. Another feature of this aspect of the invention is that the plurality of fluid injection ports may be substantially evenly spaced about the periphery of the longitudinal bore. Another feature of this aspect of the invention is that the valve may further include at least one backflow prevention device for preventing backflow of injection fluids from the fluid flowpath into the source of injection fluid. Another feature of this aspect of the invention is that the at least one backflow prevention device may be a one-way check valve. Another feature of this aspect of the invention is that the valve may further include a first backflow prevention device and a second backflow prevention device, the first and second backflow prevention devices being disposed in series relationship with the fluid flowpath and a fluid injection conduit connected to the source of injection fluid. Another feature of this aspect of the invention is that the first and second backflow prevention devices may be one-way check valves. Another feature of this aspect of the invention is that the valve may further include at least one testing device connected to the fluid injection conduit for checking the integrity of the fluid injection conduit. Another feature of this aspect of the invention is that the testing device may include a housing having a rupturable member disposed therein. Another feature of this aspect of the invention is that the rupturable member may be a rupture disc. Another feature of this aspect of the invention is that the testing device may include a housing having a rupturable lip, and a plug for sealably mating with an aperture formed by the rupturable lip. Another feature of this aspect of the invention is that the housing of the testing device may further include at least one control conduit extension having at least one flow port.

In another aspect, the invention may be a subsurface safety valve for controlling fluid flow in a well conduit including: a body member having a longitudinal bore extending therethrough; a valve actuator disposed for axial movement within the longitudinal bore; means for controllably moving the valve actuator within the longitudinal bore; a closure member mounted within the body member to control fluid flow through the longitudinal bore; means for biasing the closure member to a normally closed position to prevent fluid flow through the longitudinal bore; means for biasing the valve actuator away from the closure member; a fluid injection conduit connecting a source of injection fluid to the body member; a fluid flowpath disposed within the body member and in fluid communication with the fluid injection conduit; and a lockout sleeve disposed within the longitudinal bore, the lockout sleeve having an inner bore for receiving a first end of the valve actuator, and a fluid passageway in fluid communication with the fluid flowpath and the inner bore. Another feature of this aspect of the invention is that the fluid injection conduit may be controllably connected to a source of injection fluid located at the earth's surface. Another feature of this aspect of the invention is that the fluid passageway in the lockout sleeve may include an annular fluid passageway and a plurality of fluid injection ports, the annular fluid passageway being in fluid communication with the fluid flowpath, and the plurality of fluid injection ports being in fluid communication with the annular fluid passageway and the inner bore. Another feature of this aspect of the invention is that the plurality of fluid injection ports may extend radially inwardly from the annular fluid passageway to the inner bore. Another feature of this aspect of the invention is that the plurality of fluid injection ports may be substantially evenly spaced about a periphery of the inner bore. Another feature of this aspect of the invention is that the lockout sleeve may include a shoulder having a first face, the fluid passageway being disposed in the first face, the safety valve further including means for sealing the fluid passageway. Another feature of this aspect of the invention is that the sealing means may include a sealing ring disposed adjacent the first face, and a retainer ring for securing the sealing ring to the first face. Another feature of this aspect of the invention is that the sealing ring may be made of Teflon. Another feature of this aspect of the invention is that the plurality of fluid injection ports may extend radially inwardly from the annular fluid passageway to the inner bore. Another feature of this aspect of the invention is that the plurality of fluid injection ports may be substantially evenly spaced about a periphery of the inner bore. Another feature of this aspect of the invention is that the longitudinal bore may include an annular groove in fluid communication with the fluid flowpath in the body member and the fluid passageway in the lockout sleeve. Another feature of this aspect of the invention is that the fluid passageway in the lockout sleeve may include a plurality of fluid injection ports in fluid communication with the annular groove and the inner bore of the lockout sleeve. Another feature of this aspect of the invention is that the plurality of fluid injection ports may extend radially inwardly from the annular groove to the inner bore. Another feature of this aspect of the invention is that the plurality of fluid injection ports may be substantially evenly spaced about a periphery of the lockout sleeve. Another feature of this aspect of the invention is that the valve may further include at least one backflow prevention device for preventing backflow of injection fluids from the fluid flowpath into the fluid injection conduit. Another feature of this aspect of the invention is that the at least one backflow prevention device may be a one-way check valve. Another feature of this aspect of the invention is that the valve may further include a first backflow prevention device and a second backflow prevention device, the first and second backflow prevention devices being disposed in series relationship with the fluid flowpath and the fluid injection conduit. Another feature of this aspect of the invention is that the first and second backflow prevention devices may be one-way check valves. Another feature of this aspect of the invention is that the valve may further include at least one testing device connected to the fluid injection conduit for checking the integrity of the fluid injection conduit. Another feature of this aspect of the invention is that the testing device may include a housing having a rupturable member disposed therein. Another feature of this aspect of the invention is that the rupturable member may be a rupture disc. Another feature of this aspect of the invention is that the testing device may include a housing having a rupturable lip, and a plug for sealably mating with an aperture formed by the rupturable lip. Another feature of this aspect of the invention is that the housing of the testing device may further include at least one control conduit extension having at least one flow port.

In yet another aspect, the invention may be a method of equalizing pressure in a subsurface safety valve, the subsurface safety valve having a body member having a longitudinal bore extending therethrough, a valve actuator disposed for axial movement within the longitudinal bore, means for controllably moving the valve actuator within the longitudinal bore, a closure member mounted within the body member to control fluid flow through the longitudinal bore, means for biasing the closure member to a normally closed position to prevent fluid flow through the longitudinal bore, means for biasing the valve actuator away from the closure member, a fluid injection conduit connecting a source of injection fluid to the body member, and a fluid flowpath disposed within the body member, the flowpath being in fluid communication with the fluid injection conduit and the longitudinal bore, the method comprising the steps of: closing a master valve that controls fluid flow in a well conduit to which the safety valve is connected; and pumping pressurized fluid into the fluid injection conduit, through the fluid flowpath in the body member, and into the longitudinal bore above the closure member until pressure above and below the closure member is equalized. Another feature of this aspect of the invention is that the pressurized fluid being pumped into the longitudinal bore may be contained by a chamber formed within the well conduit above the closure member and below the closed master valve.

While the invention will be described in connection with the preferred embodiments, it will be understood that it is not intended to limit the invention to those embodiments. On the contrary, it is intended to cover all alternatives, modifications, and equivalents as may be included within the spirit and scope of the invention as defined by the appended claims.

DETAILED DESCRIPTION OF THE INVENTION

Figure 1A:
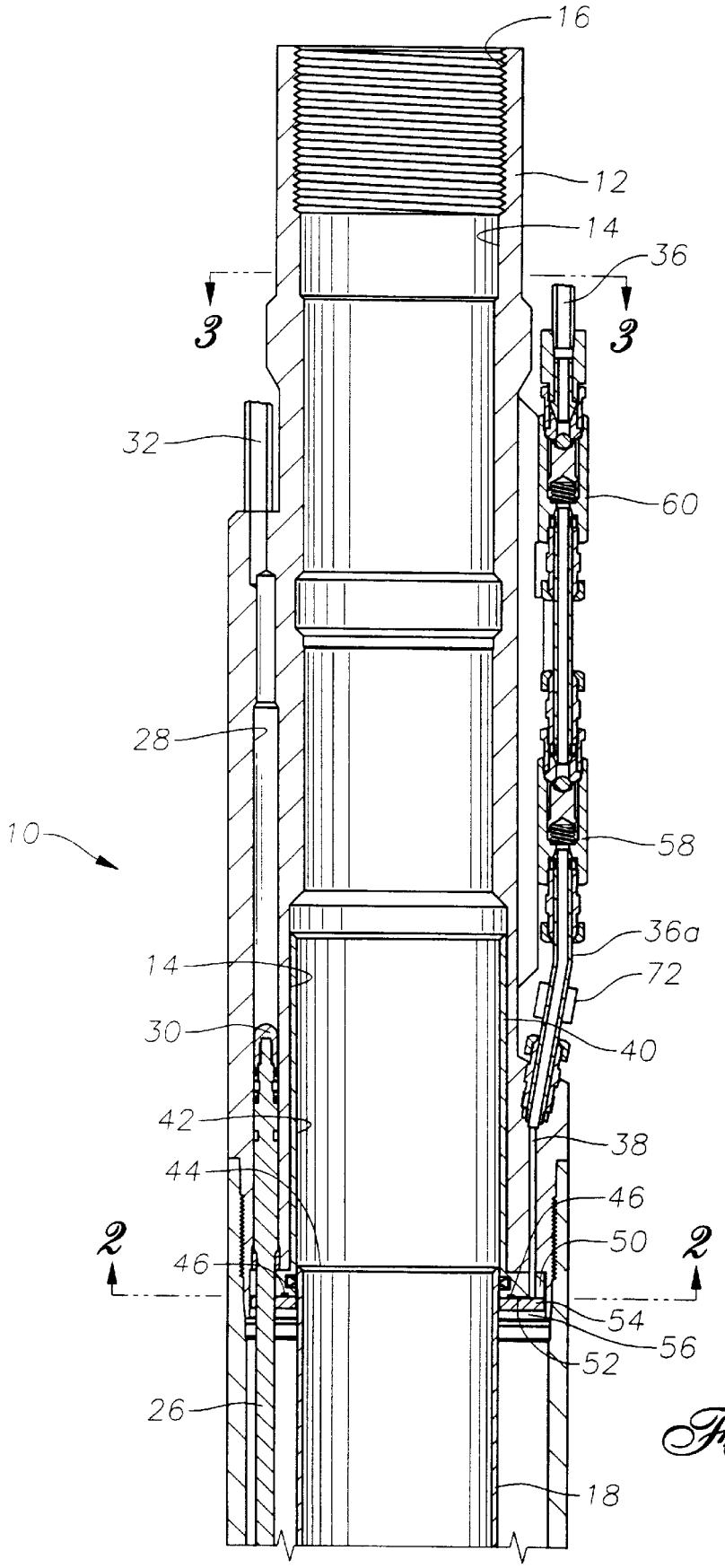
FIGS. 1A–1B illustrate a longitudinal cross-sectional view of the present invention.
Figure 1B:
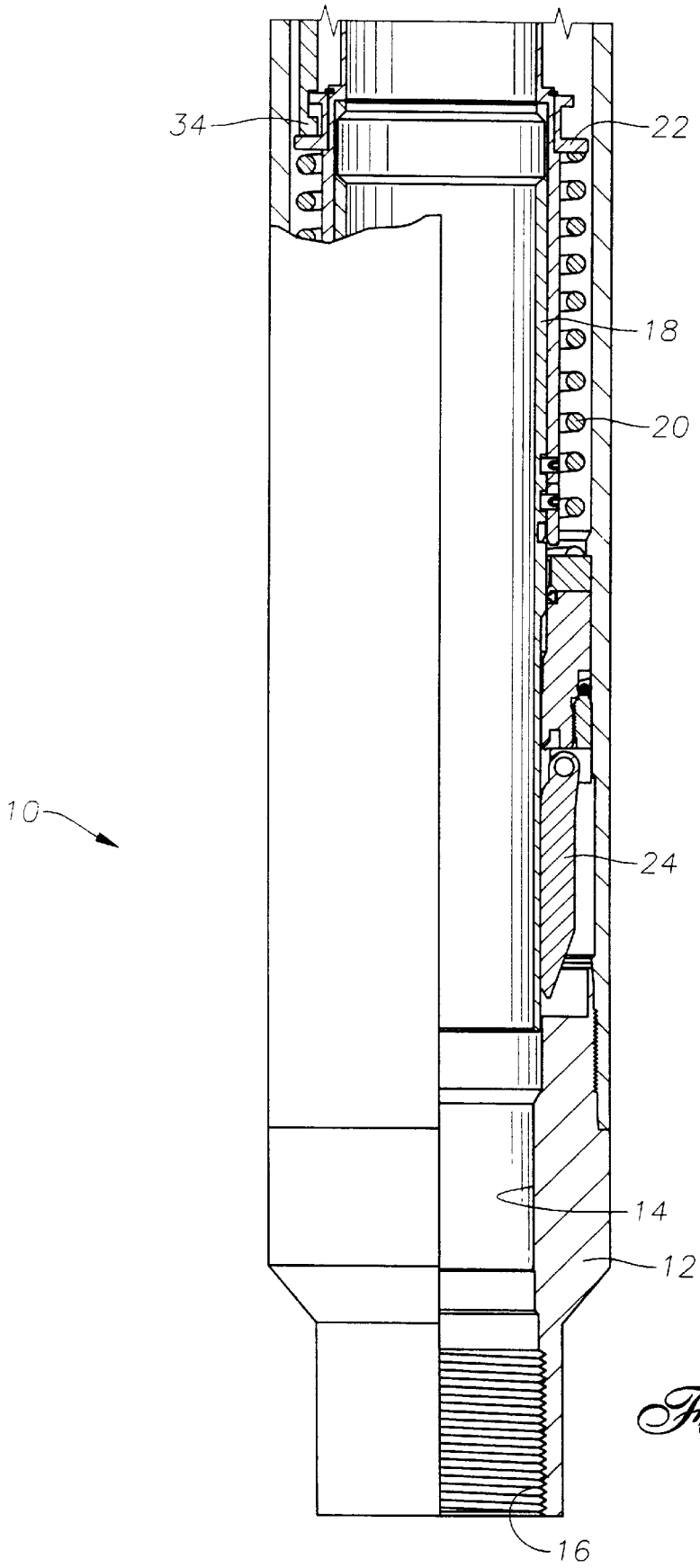

Referring to the drawings in detail, wherein like numerals denote identical elements throughout the several views, there is shown in FIGS. 1A–1B a specific embodiment of a subsurface safety valve 10 constructed in accordance with the present invention. With reference to FIG. 1A, the subsurface safety valve 10 of this specific embodiment is comprised of a generally tubular body member 12 with a longitudinal bore 14 that extends therethrough. Each end of the body 12 includes mechanisms, such as threads 16, for interconnection with a well conduit 68 (FIG. 8) suspended within a wellbore 69. Referring to FIG. 1B, a valve actuator 18, usually referred to as a flow tube, is disposed within the bore 14 and is adapted for axial movement therein. The flow tube 18 includes a spring 20 disposed therearound that acts upon a shoulder 22 on the flow tube 18 biasing the flow tube 18 away from a closure member 24. The closure member 24 is mounted within the body member 12 to control fluid flow through the longitudinal bore 14.

As shown in FIG. 1A, in a specific embodiment, a rod-piston system (or other hydraulic operating piston, such as an annular piston) may be provided to controllably move the flow tube 18 within the longitudinal bore 14, and to open the closure member 24. In a specific embodiment, the rod-piston system may comprise a piston 26 sealably mounted for reciprocal movement within a cylinder 28 located within the wall of the tubular body 12. A first end 30 of the piston 26 is in contact with hydraulic fluid (not shown) provided thereto from the earth's surface through a relatively small diameter control conduit 32. A second end 34 of the piston 26 is operatively connected, in any suitable manner, to the flow tube 18. When the pressure of hydraulic fluid in the control conduit 32 exceeds the force needed to compress the spring 20, the piston 26 is forced downwardly, thereby causing the flow tube 18 to come into contact with, and open, the closure member 24. In the event that the hydraulic pressure applied to the piston 26 is decreased, as by command from the earth's surface or by the control conduit 32 being damaged, the spring 20 forces the flow tube 18 upwardly away from the closure member 24. The closure member 24 is then rotated, and biased, into a closed position by action of a hinge spring (not shown) to a normally closed position to prevent fluid flow into the flow tube 18 and through the longitudinal bore 14.

Figure 2:
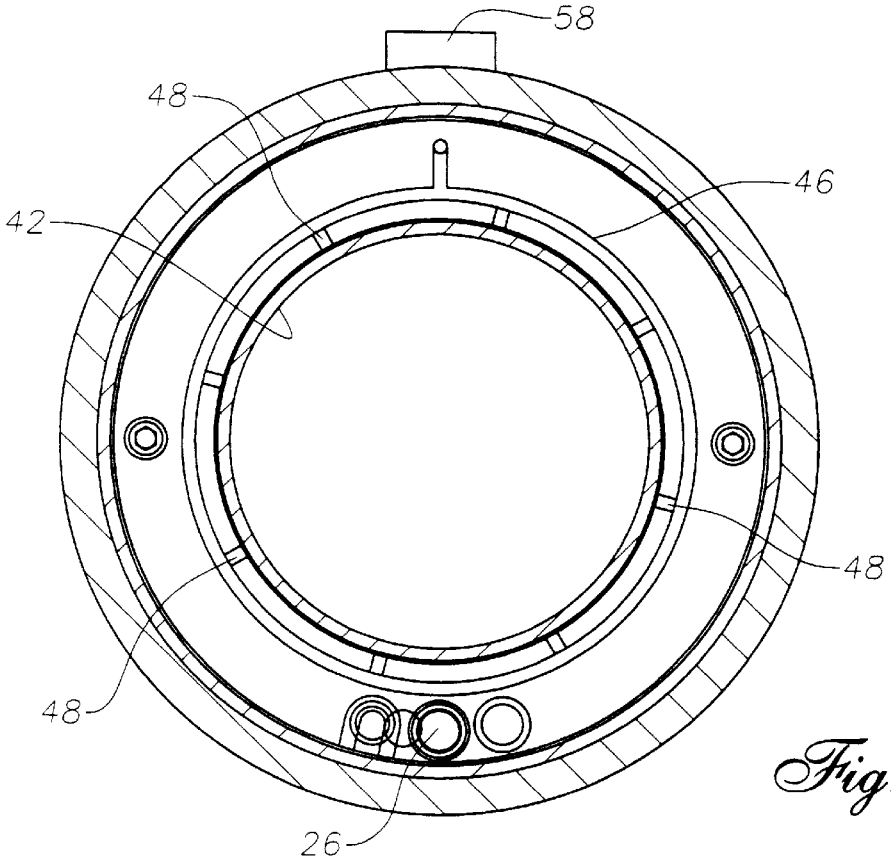
FIG. 2 is a cross-sectional view taken along line 2—2 of FIG. 1A.
Figure 3:
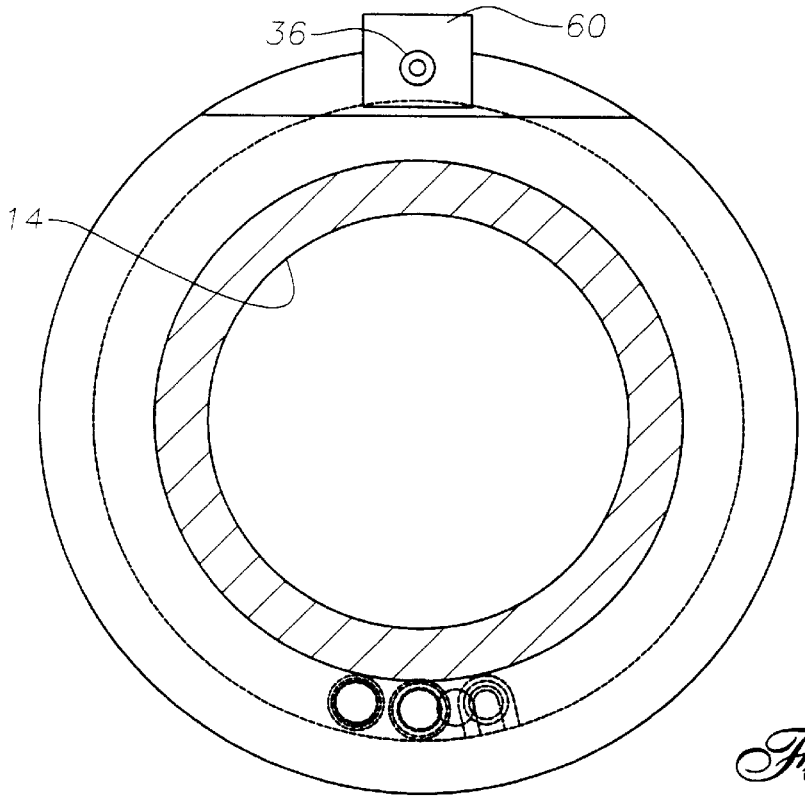
FIG. 3 is a cross-sectional view taken along line 3—3 of FIG. 1A.
Figure 7:
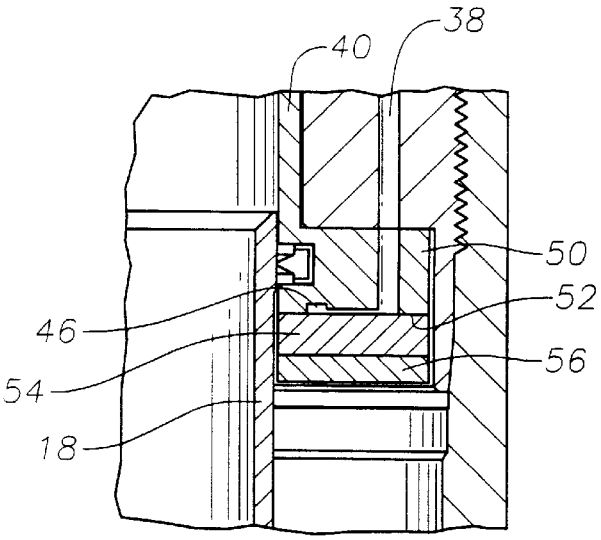
FIG. 7 is an exploded view of a portion of the safety valve shown in FIG. 1A.

In accordance with a primary objective of the present invention, the subsurface safety valve may also be provided with a system for injecting fluids—such as chemicals for retarding corrosion, scale, parafin, asphaltenes, and the like—into the longitudinal bore 14. Referring to FIG. 1A, in a specific embodiment, the system may include a fluid injection conduit 36 controllably connecting a source of injection fluid 37 (FIG. 8) at the earth's surface 66 to the body member 12; a fluid flowpath 38 disposed within the body member 12 and in fluid communication with the fluid injection conduit 36; and a lockout sleeve 40 disposed within the longitudinal bore 14. The lockout sleeve 40 may be provided with an inner bore 42 for receiving a first end 44 of the valve actuator 18, and a fluid passageway in fluid communication with the fluid flowpath 38 and the longitudinal bore 14. As best shown in FIG. 2, in a specific embodiment, the fluid passageway may include an annular fluid passageway 46 and a plurality of fluid injection ports 48. The annular fluid passageway 46 is in fluid communication with the fluid flowpath 38, and the plurality of fluid injection ports 48 are in fluid communication with the annular fluid passageway 46 and the inner bore 42. In a specific embodiment, the plurality of fluid injection ports 48 may extend radially inwardly from the annular fluid passageway 46 to the inner bore 42, and may be substantially evenly spaced about a periphery of the inner bore 42. In another specific embodiment, as best shown in FIG. 7, which is an enlarged view of a portion of the safety valve shown in FIG. 1A, the lockout sleeve 40 may include a shoulder 50 having a first face 52, and the annular fluid passageway 46 and the plurality of fluid injection ports 48 (FIG. 2) may be disposed in the first face 52. This embodiment may also be provided with a sealing ring 54 disposed adjacent the first face 52, and a retainer ring 56 for securing the sealing ring 54 to the first face 52. In a specific embodiment, the sealing ring 54 may be made of Teflon, or other suitable compliant material.

Figure 9:
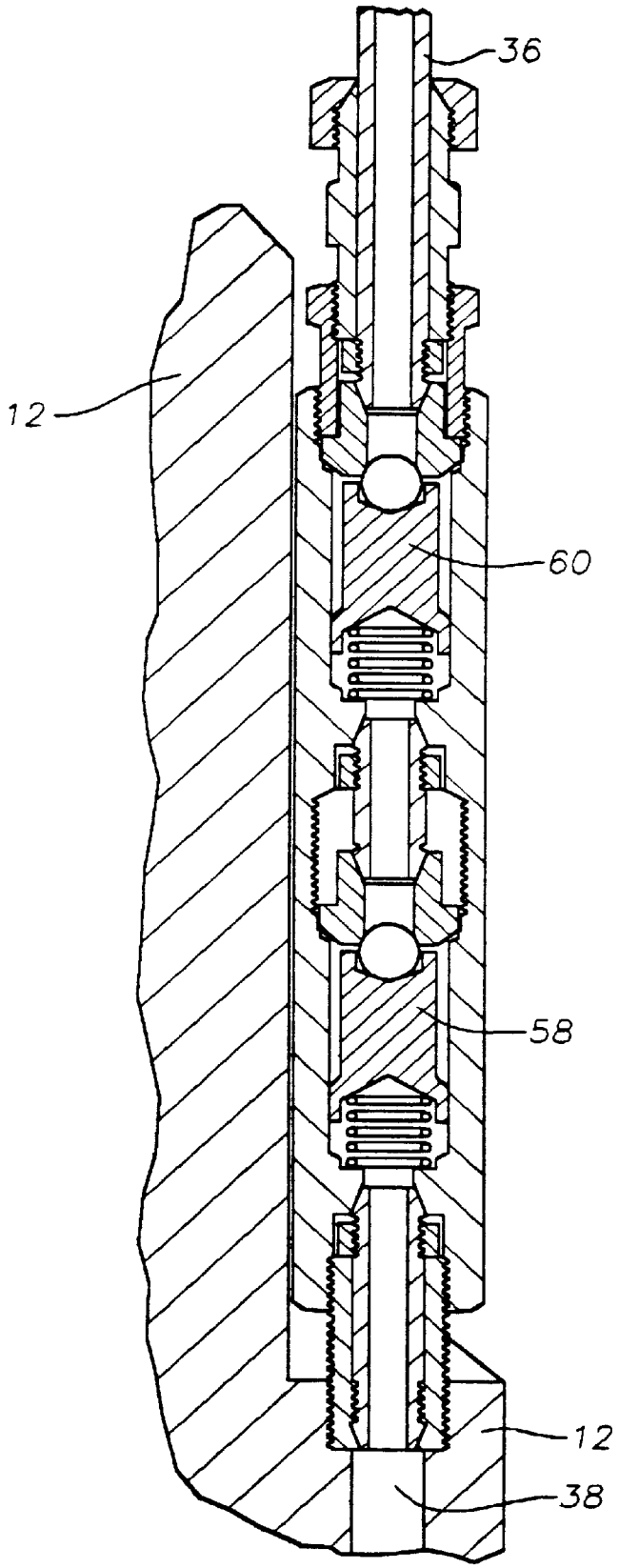
FIG. 9 is a longitudinal view showing an alternative embodiment of a back flow prevention device.

In another specific embodiment, as shown in FIG. 1A, the safety valve 10 of the present invention may be provided with one or more devices to prevent backflow of injection fluids from the flowpath 38 into the fluid injection conduit 36, such as first and second one-way check valves 58 and 60. In a specific embodiment, the check valves 58 and 60 may be disposed in series relationship with the fluid flowpath 38 and the fluid injection conduit 36, and be in fluid communication therewith. In this embodiment, in the event one of the check valves 58 or 60 fail, the other valve will still function, thereby serving as a back-up or redundant valve. In a specific embodiment, the check valves 58 and 60 may be O-ring or ball check valves, of a type well known to those of skill in the art. In another specific embodiment, as shown in FIG. 9, the check valves 58 and 60 may be directly connected to one another in series relationship, instead of having a section of control line disposed therebetween, as is the case with the embodiment shown in FIG. 1A. Also, with reference to FIG. 9, the first check valve 58 may be connected directly to the body member 12, instead of having a section of conduit disposed between the first check valve 58 and the body member 12, as is the case with the embodiment shown in FIG. 1A. In this manner, the number of leak paths may be reduced. It is to be understood that the scope of the invention is not intended to be limited to any particular backflow prevention device, but that other devices that allow fluid flow in only one direction, as known to those of skill in the art, are intended to be within the spirit and scope of this invention.

Figure 4:
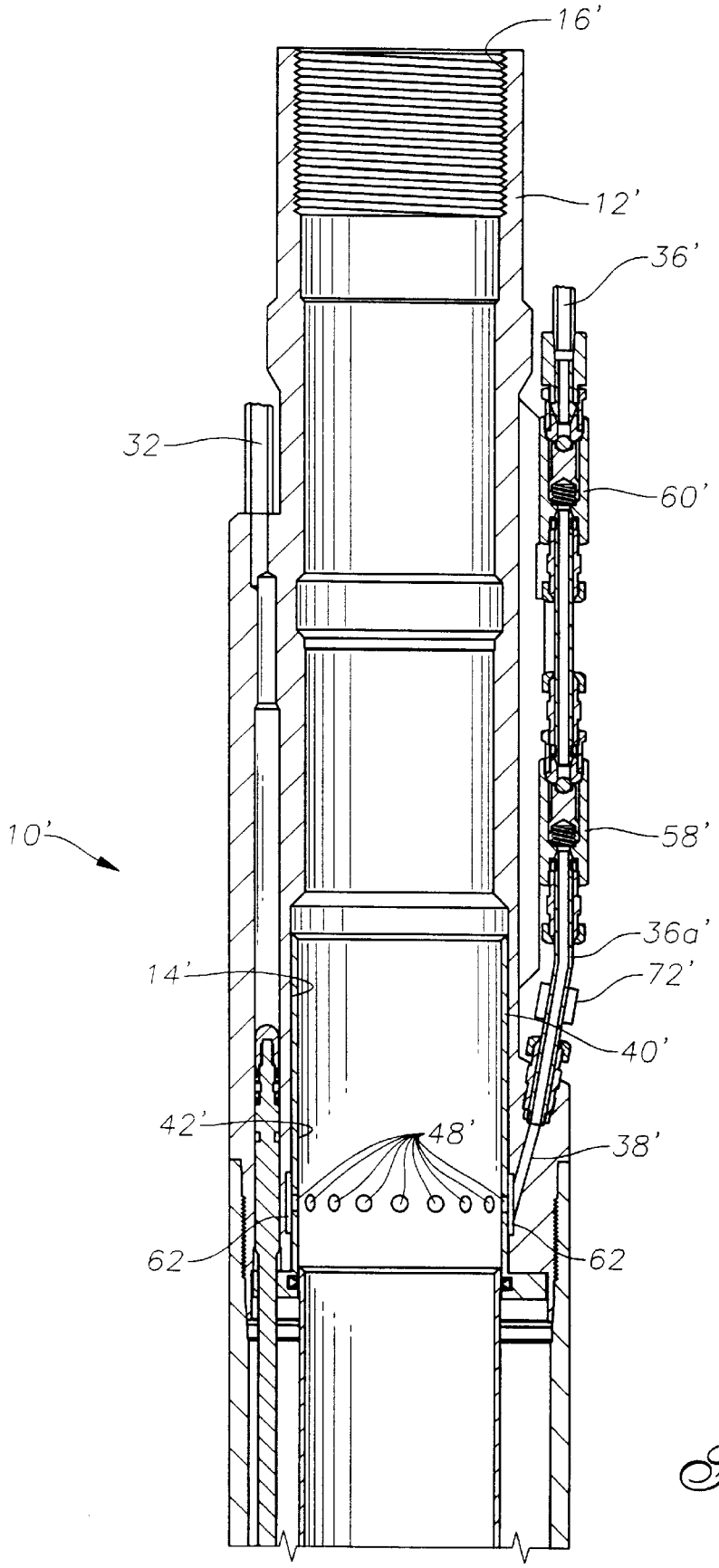
FIG. 4 is a longitudinal cross-sectional view, similar to FIG. 1A, showing an alternative specific embodiment of the present invention.

Another specific embodiment of the valve 10' of the present invention is shown in FIG. 4, wherein the longitudinal bore 14' may include an annular groove 62 in fluid communication with a fluid flowpath 38' in the body member 12', and with a plurality of fluid injection ports 48' in the lockout sleeve 40'. The fluid flowpath 38' is in fluid communication with a fluid injection conduit 36', which may be provided with one or more backflow prevention devices, such as first and second one-way check valves 58' and 60', in the same manner as discussed above in connection with FIGS. 1A and 9. The plurality of fluid injection ports 48' are in fluid communication with the annular groove 62 and with an inner bore 42' of the lockout sleeve 40'. In a specific embodiment, the plurality of fluid injection ports 48' may extend radially inwardly from the annular groove 62 to the inner bore 42' and may be substantially evenly spaced about a periphery of the lockout sleeve 40'.

Referring to FIG. 1A, in another specific embodiment of the present invention, the subsurface safety valve 10 may be provided with a testing device 72 in a section of control line 36*a* between the first check valve 58 and the fluid flowpath 38 in the body member 12. In a broad aspect, the function of the testing device 72 is to test the integrity of the fluid injection conduit 36, and any fittings connected to the conduit 36, such as the check valves 58 and 60, between the subsurface safety valve 10 and the fluid source 37 at the earth's surface 66 (see FIG. 8). In a more particular aspect, the function of the testing device 72 is to verify that there are no leaks in the injection conduit 36, or in any related connection, and to verify that the injection conduit 36, and any related connections, will operate at a minimum operating pressure. The testing device 72 may be provided in numerous forms, as will be readily apparent to those of skill in the art, all of which are intended to be within the spirit and scope of the present invention.

Figure 5:
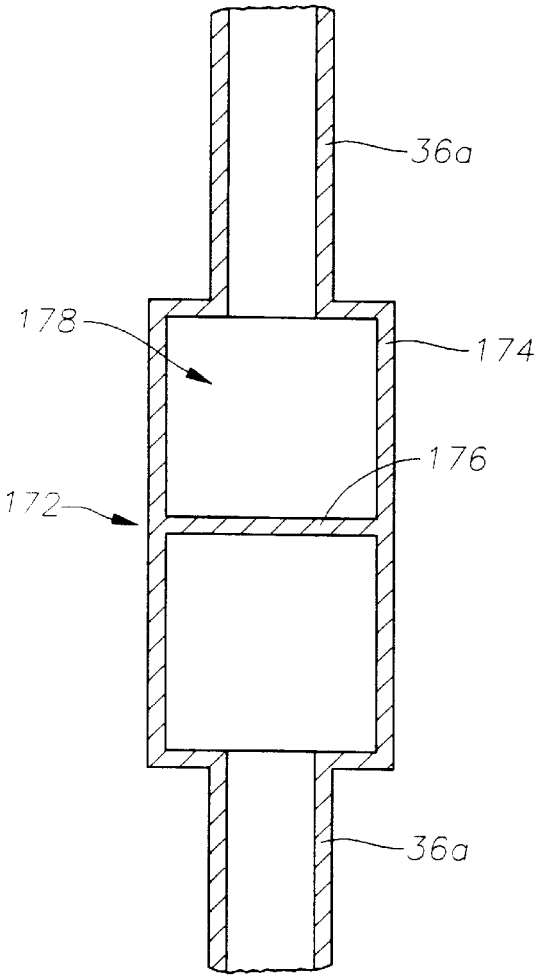
FIG. 5 is a cross-sectional view of one embodiment of a testing device for testing the integrity of a fluid injection conduit.

Referring to FIG. 5, in a specific embodiment, a testing device 172 may include a housing 174 connected to the section of control line 36*a*, and a rupturable member 176 disposed within an interior 178 of the housing 174. The rupturable member 176 is designed to restrict fluid flow through the control line 36*a* unless a predetermined fluid pressure is exceeded, at which time the rupturable member 176 will rupture and permit fluid flow through the control line 36*a*. In a specific embodiment, the rupturable member 176 may be a rupture disc.

Figure 6:
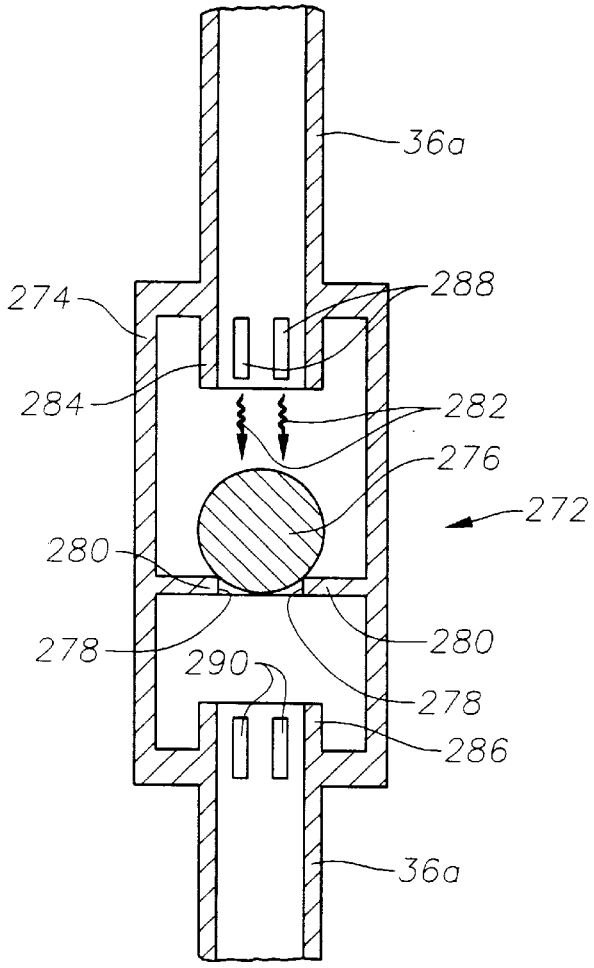
FIG. 6 is a cross-sectional view of another embodiment of a testing device for testing the integrity of the fluid injection conduit.

Referring to FIG. 6, in another specific embodiment, a testing device 272 may include a housing 274 connected to the section of control line 36*a*, and a plug 276 for mating with an aperture 280 formed by a rupturable lip 280 inside the housing 274. Injection fluid pressure 282 forces the plug 276 into sealing relationship with the aperture 278 to restrict fluid flow through the control line 36*a*. The testing device 272 is designed so that the lip 280 will fail at a predetermined pressure. When the predetermined pressure is exceeded, the lip 280 will fail so as to allow fluid to flow through the control line 36*a*. After the lip fails, the plug 276 will rest against a first or second control conduit extension 284 or 286, each of which are provided with flow ports 288 and 290, respectively. When fluid is flowing from the earth's surface 66 into the safety valve 10, the plug 276 will rest against the second extension 286, and the injection fluid will flow through the flow ports 290 into the conduit 36*a*. If there should be any backflow through the device 272, the plug 276 may be forced upwardly against the first extension 284, in which case the injection fluid will be permitted to continue to flow upwardly through the flow ports 288. It will be apparent to those of skill in the art that the purpose of the first and second extensions 284 and 286, along with their respective flow ports 288 and 290, is to prevent the plug 276 from blocking fluid flow through the testing device 272 after the lip 280 has ruptured.

It can now be seen that the safety valve 10 satisfies a primary objective of the present invention by providing a system for injecting fluids—such as for chemicals for retarding corrosion, scale, parafin, asphaltenes, and the like—into the longitudinal bore 14. In operation, fluids may be transmitted, by operation of controls (not shown) at the earth's surface 66 (see FIG. 8), down the fluid injection conduit 36/36', through the fluid flowpath 38/38', and into the longitudinal bore 14/14'. If the safety valve 10/10' is provided with a plurality of fluid injection ports 48/48', such as in the lockout sleeve 40/40', the fluid may be transmitted from the fluid flowpath 38/38' through the plurality of fluid injection ports 48/48' and into the inner bore 42/42'. In this manner, the injection fluids may be more evenly distributed inside the safety valve 10.

Figure 8:
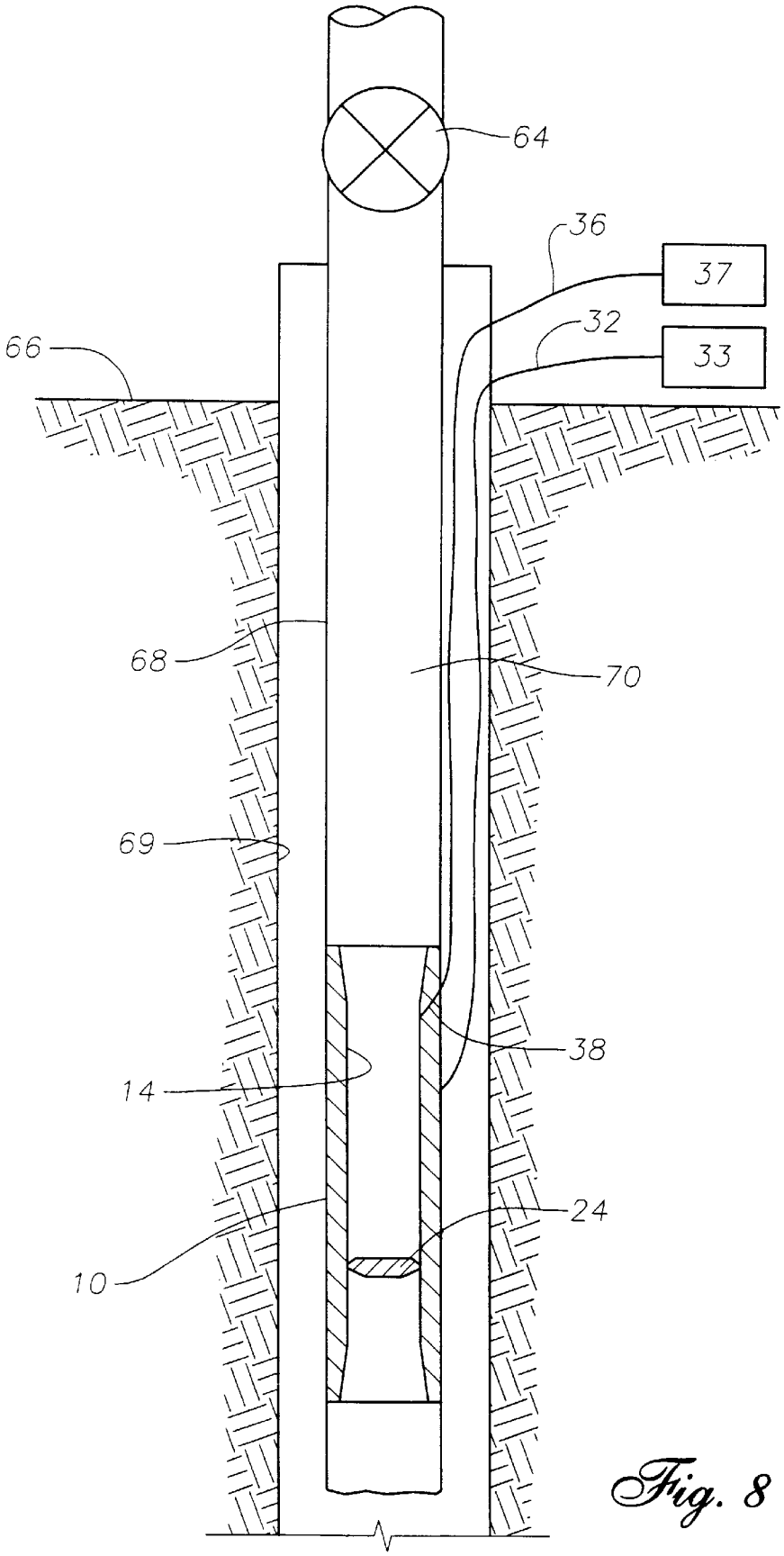
FIG. 8 is a schematic view of wellbore having a well conduit suspended therein, the well conduit having a safety valve of the present invention connected thereto.

In accordance with another important object of the present invention, the fluid injection conduit 36 and the fluid flowpath 38 may provide the safety valve 10 with a pressure equalization feature to overcome a problem that may arise when moving the valve closure member 24 from its closed to its open position. As explained above, when the closure member 24 is in its closed position, well fluid pressure below the closure member 24 acting upon a relatively large surface area of the valve closure member 24 makes opening of the member 24 difficult. By use of the present invention, pressure above and below the closure member 24 may be equalized prior to its opening, thereby significantly reducing the force required to open the closure member 24. Referring to FIG. 8, pressure equalization is achieved under the present invention by first closing a valve 64, commonly referred to as the master valve, located at the earth's surface 66. The valve 64 controls fluid flow from a well conduit 68 that is disposed within a well bore 69. The safety valve 10 of the present invention is connected to the well conduit 68. After closing the master valve 64, pressurized fluid is pumped down the fluid injection conduit 36, through the internal fluid flowpath 38, and into the longitudinal bore 14 above the closure member 24. The pressurized fluid is pumped into the bore 14 until a chamber 70 that is formed within the well conduit 68 above the closure member 24 and below the closed master valve 64 is fully occupied by pressurized fluid and the pressure above and below the closure member 24 is equalized. Hydraulic pressure from a source of hydraulic fluid 33 at the earth's surface 66 may then be applied through the hydraulic control conduit 32 to the safety valve 10 to open the closure member 24 in a manner known to those of ordinary skill in the art.

It is to be understood that the invention is not limited to the exact details of construction, operation, exact materials or embodiments shown and described, as obvious modifications and equivalents will be apparent to one skilled in the art. For example, while the present invention has been described in relation to a particular type of safety valve, namely a "rod-piston" type safety valve, similar to the one shown in U.S. Pat. No. 4,161,219, it should be understood that the present invention may be used in any commercially available safety valve, whether it be tubing conveyed, wireline conveyed, hydraulically operated, or electrically operated. Accordingly, the invention is therefore to be limited only by the scope of the appended claims.

What is claimed is:

1. A subsurface safety valve for controlling fluid flow in a well conduit, comprising:

a body member having a longitudinal bore extending therethrough;

a closure member mounted within the body member to control fluid flow through the longitudinal bore;

a valve actuator disposed for movement within the body member and remotely shiftable to move the closure member between open and closed positions;

a fluid flowpath disposed within the body member, the flowpath being in fluid communication with the longitudinal bore and a fluid injection conduit, the fluid injection conduit being in fluid communication with a source of injection fluid; and at least one testing device connected to the fluid injection conduit for checking the integrity of the fluid injection conduit, the testing device including a housing having a rupturable member disposed therein.

2. The subsurface safety valve of claim 1, wherein a fluid injection conduit controllably connects the fluid flowpath to the source of injection fluid.

3. The subsurface safety valve of claim 1, further including an annular fluid passageway disposed within the body member and in fluid communication with the fluid flowpath, and a plurality of fluid injection ports in fluid communication with the annular fluid passageway and the longitudinal bore.

4. The subsurface safety valve of claim 3, wherein the plurality of fluid injection ports extend radially inwardly from the annular fluid passageway to the longitudinal bore.

5. The subsurface safety valve of claim 3, wherein the plurality of fluid injection ports are substantially evenly spaced about the periphery of the longitudinal bore.

6. The subsurface safety valve of claim 1, further including at least one backflow prevention device for preventing backflow of injection fluids from the fluid flowpath into the source of injection fluid.

7. The subsurface safety valve of claim 6, wherein the at least one backflow prevention device is a one-way check valve.

8. The subsurface safety valve of claim 1, further including a first backflow prevention device and a second backflow prevention device, the first and second backflow prevention devices being disposed in series relationship with the fluid flowpath and a fluid injection conduit connected to the source of injection fluid.

9. The subsurface safety valve of claim 8, wherein the first and second backflow prevention devices are one-way check valves.

10. The subsurface safety valve of claim 8, wherein the first and second backflow prevention devices are connected directly to each other.

11. The subsurface safety valve of claim 8, wherein the first backflow prevention device is connected directly to the body member.

12. The subsurface safety valve of claim 1, wherein the rupturable member is a rupture disc.

13. The subsurface safety valve of claim 1, wherein the rupturable member includes a rupturable lip, and the testing device further includes a plug for sealably mating with an aperture formed by the rupturable lip.

14. The subsurface safety valve of claim 13, wherein the housing of the testing device further includes at least one control conduit extension having at least one flow port.

15. A subsurface safety valve for controlling fluid flow in a well conduit, comprising:

a body member having a longitudinal bore extending therethrough;

a closure member mounted within the body member to control fluid flow through the longitudinal bore, a valve actuator disposed for movement within the body member and remotely shiftable to move the closure member between open and closed positions;

a fluid injection conduit connecting a source of injection fluid to the body member;

a fluid flowpath disposed within the body member and in fluid communication with the fluid injection conduit; and, a lockout sleeve disposed within the longitudinal bore, the lockout sleeve having an inner bore for receiving a first end of the valve actuator, a fluid passageway in fluid communication with the fluid flowpath and the inner bore, and a shoulder having a first face, the fluid passageway being disposed in the first face, sealed by a seal and including an annular fluid passageway and a plurality of fluid injection ports, the annular fluid passageway being in fluid communication with the fluid flowpath, and the plurality of fluid injection ports being in fluid communication with the annular fluid passageway and the inner bore.

16. The subsurface safety valve of claim 15, wherein the fluid injection conduit is controllably connected to a source of injection fluid located at the earth's surface.

17. The subsurface safety valve of claim 15, wherein the seal includes a sealing ring disposed adjacent the first face, and a retainer ring for securing the sealing ring to the first face.

18. The subsurface safety valve of claim 17, wherein the sealing ring is made of Teflon.

19. The subsurface safety valve of claim 15, wherein the plurality of fluid injection ports extend radially inwardly from the annular fluid passageway to the inner bore.

20. The subsurface safety valve of claim 15, wherein the plurality of fluid injection ports are substantially evenly spaced about a periphery of the inner bore.

21. The subsurface safety valve of claim 15, wherein the longitudinal bore includes an annular groove in fluid communication with the fluid flowpath in the body member and the fluid passageway in the lockout sleeve.

22. The subsurface safety valve of claim 21, wherein the fluid passageway in the lockout sleeve includes a plurality of fluid injection ports in fluid communication with the annular groove and the inner bore of the lockout sleeve.

23. The subsurface safety valve of claim 22, wherein the plurality of fluid injection ports extend radially inwardly from the annular groove to the inner bore.

24. The subsurface safety valve of claim 22, wherein the plurality of fluid injection ports are substantially evenly spaced about a periphery of the lockout sleeve.

25. The subsurface safety valve of claim 15, further including at least one backflow prevention device for preventing backflow of injection fluids from the fluid flowpath into the fluid injection conduit.

26. The subsurface safety valve of claim 25, wherein the at least one backflow prevention device is a one-way check valve.

27. The subsurface safety valve of claim 15, further including a first backflow prevention device and a second backflow prevention device, the first and second backflow prevention devices being disposed in series relationship with the fluid flowpath and the fluid injection conduit.

28. The subsurface safety valve of claim 27, wherein the first and second backflow prevention devices are one-way check valves.

29. The subsurface safety valve of claim 27, wherein the first and second backflow prevention devices are connected directly to each other.

30. The subsurface safety valve of claim 27, wherein the first backflow prevention device is connected directly to the body member.

31. The subsurface safety valve of claim 15, further including at least one testing device connected to the fluid injection conduit for checking the integrity of the fluid injection conduit.

32. The subsurface safety valve of claim 31, wherein the testing device includes a housing having a rupturable member disposed therein.

33. The subsurface safety valve of claim 32, wherein the rupturable member is a rupture disc.

34. The subsurface safety valve of claim 31, wherein the testing device includes a housing having a rupturable lip, and a plug for sealably mating with an aperture formed by the rupturable lip.

35. The subsurface safety valve of claim 34, wherein the housing of the testing device further includes at least one control conduit extension having at least one flow port.

* * * * *